United States Patent [19]

Akiko

[11] Patent Number: 4,938,464

[45] Date of Patent: Jul. 3, 1990

[54] OBSTETRIC EXAMINING TABLE APPARATUS

[75] Inventor: Tabuchi Akiko, Okayama, Japan

[73] Assignee: Kazuhisa Tabuchi, Okayama, Japan

[21] Appl. No.: 401,524

[22] Filed: Aug. 29, 1989

Related U.S. Application Data

[63] Continuation-in-part of Ser. No. 129,845, Dec. 8, 1987, abandoned.

[51] Int. Cl.[5] ..... A61G 15/00

[52] U.S. Cl. ..... 269/323

[58] Field of Search ..... 269/322–327; 297/349

[56] References Cited

U.S. PATENT DOCUMENTS

| | | | |
|---|---|---|---|
| 3,837,635 | 9/1974 | Long et al. | 269/325 |
| 4,168,099 | 9/1979 | Jacobs et al. | 269/325 |
| 4,225,127 | 9/1980 | Strutton | 269/325 |
| 4,600,239 | 7/1986 | Gerstein | 297/349 |

*Primary Examiner*—Robert C. Watson
*Attorney, Agent, or Firm*—Koda & Androlia

[57] ABSTRACT

Conventional obstetric examining table apparatuses only include a height adjuster and reclining device for reclining a back rest and are designed such that the patient steps on and off of the examining table from the side, which is often inconvenient for the patient.

The obstetric examining table apparatus of this invention has a rotating device and an elevating device for the examining table incorporated therein and also includes an open space at the center and thigh crutches on both sides of the examining table. The examining table is set on the side of the doctor, and the patient sits down on the examining table from the front and spreads her legs in order to prepare for the examination. Then, the examining table is turned and raised to an appropriate height so that the diseased area can be properly positioned for the examination.

4 Claims, 4 Drawing Sheets

OBSTETRIC EXAMINING TABLE APPARATUS

This is a continuation-in-part of application Ser. No. 129,845, filed Dec. 8, 1987, now abandoned.

OBSTETRIC EXAMINING TABLE APPARATUS

Background of the invention

1. Field of the invention

The present invention relates to an obstetric examining table apparatus with an improvement in that a pregnant or woman in labor can easily step on and off of the examining table of the examining table apparatus.

2. Prior Art

There are two different types of widely used conventional obstetric examining table apparatuses A manual type and an electrical type. In most cases, these apparatuses include only a height adjusting device and a reclining device. The height adjusting device moves the seat board and backrest of the examining table up and down, and the reclining device pivotally moves the backrest.

The manual examining table apparatus is designed such that the backrest of the examining table can be raised, and the legs of the patient are positioned in a dorsosacral posture (a posture wherein legs are bent and opened). The patient steps on and off of the examining table from the side using a step stool. In the electrical examining table apparatus, the patient also steps on and off of the examining table from the side. However, since in the electrical examining table apparatus, the examining table can be lowered, the patient does not need a step stool. Thus, it is usually easier to step on and off of an electric examining table apparatus.

However, it is not easy for a pregnant woman having a swollen belly to first put her buttocks on the seat board from the side of the examining table and then change her position to assume a dorsal decubital posture.

As mentioned above, with the conventional examining table apparatus, the patient steps on and off of the examining table from the side, and because of this, the treatment table and doctor's examining chair, etc. are placed in front of the examining table so that they do not obstruct the patient from stepping on and off of the examining table. However, such apparatuses, in turn, obstruct the patient from trying to step on and off from the front of the examining table with her back facing the backrest. Also, a modest pregnant woman does not want to step on and off of the examining table from the front in an undressed state in the presence of the doctors and nurses.

BRIEF DESCRIPTION OF THE INVENTION

The obstetric examining table apparatus of this invention, similar to the rotating seat seen in a barber shop or beauty salon, is designed such that the examining table can be rotated and elevated, eliminating the drawbacks of the conventional apparatuses. The essential feature of this invention is that the examining table (X) can be reclined relative to the base (1) of the examining table apparatus, and a rotating device (10) and elevating device (20) are incorporated in the base (1).

The ideal mode of the obstetric examining table apparatus having the above-mentioned structure is that the examining table can be raised and rotated simultaneously so that the patient is lifted in a spiral motion until the patient reaches an appropriate height in front of the doctor and at the same time the examining table (X) can be reclined at a desired position. The driving mechanism for rotation, elevation, reclining, etc. of the examining table (X) can be attained by incorporating existing mechanisms such as as motors, hydraulic/-pneumatic cylinders, etc. thereon. Furthermore, computerized control of the driving mechanism made in accordance with the patient's condition and type of the treatment can be performed by utilizing regular control technology.

In the above-mentioned examining table apparatus, the examining table (X) which faces the doctor can be rotated about 90 degrees so that it turns to the side of the doctor. Thus, the patient can sit down on the seat board (2) from the front in the same manner as she would sit on a low chair and then spread the legs. Therefore, stepping on and off of the examining table which the patient makes become extremely easy mentally and physically. The examining table is then turned in a reverse direction about 90 degrees and at the same time raised so that the patient faces the doctor. Accordingly, the patient does not feel any embarrassment.

As mentioned above, in conventional examining table apparatus, the patient climbs up onto and down from the examining table; however, in the present invention, the patient merely sits down the examining table which is in a form of a chair.

DETAILED DESCRIPTION OF THE INVENTION

The obstetric examining table apparatus of the present invention will be explained in a more detailed and concrete manner with reference to the accompanying drawings as follows.

Figure 1:
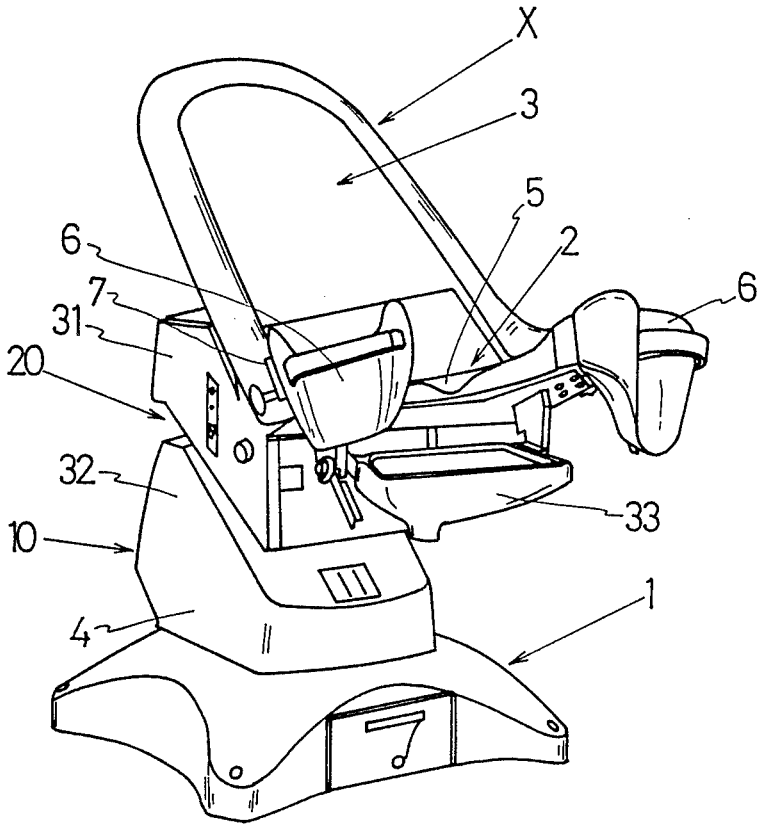
FIG. 1 is a perspective view of the obstetric examining table apparatus in accordance with the present invention.

The examining table apparatus of this invention, as is apparent from FIG. 1, is of a chair type and includes a base (1) and an examining table (X) which is reclinable on the base (1). The base (1) is installed on the floor, and the examining table (X) includes a seat board (2) and a backrest (3) which are a single unit. A rotating base (4) is mounted on the base (1), and the examining table (X) is provided on the rotating base (4). That the examining table (X) is reclinable in the present invention means that it includes not only the type of seat board (2) and backrest (3) which can be tilted as a single unit as seen in this embodiment, but also the type wherein only the backrest (3) is tilted in relation to the seat board (2) as seen in ordinary reclining seats.

The seat board (2) of the examining table (X) has an opening (5) at the central front portion and thigh crutches (6) on right and left sides. The opening (5) is in the shape of an arc-shaped cut-out. The examining table is in a bucket seat shape. More specifically, the edges of the right and left sides of the seat board (2) and the right and left sides and upper edges of the backrest (3) project inwardly. Thus, the examining table (X) eliminates armrests which are equipped on conventional devices; however, the armrests are optional and can be provided on the examining table. The inwardly projected portions at the right and left sides of the seat board (2) are respectively provided with a cut-out handle section (7).

Figure 2:
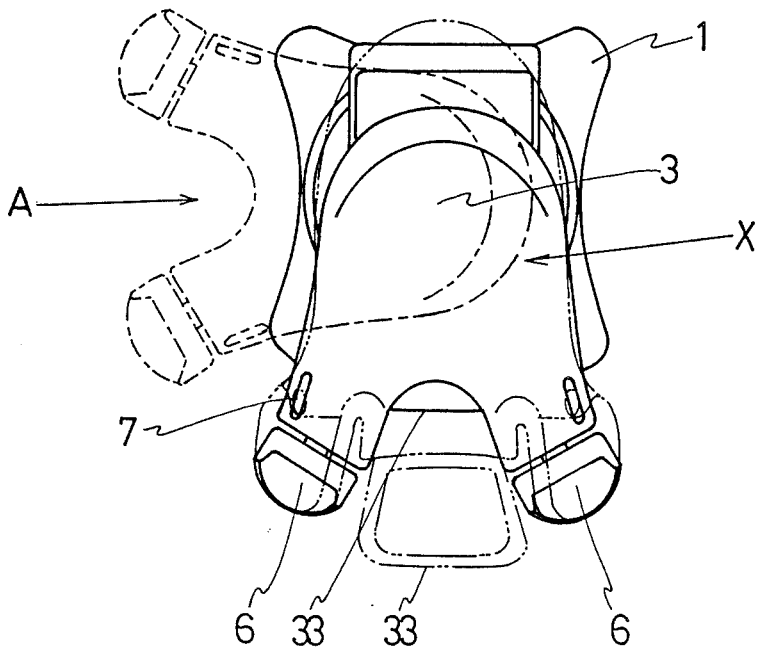
FIG. 2 is a top plan view thereof.
Figure 3:
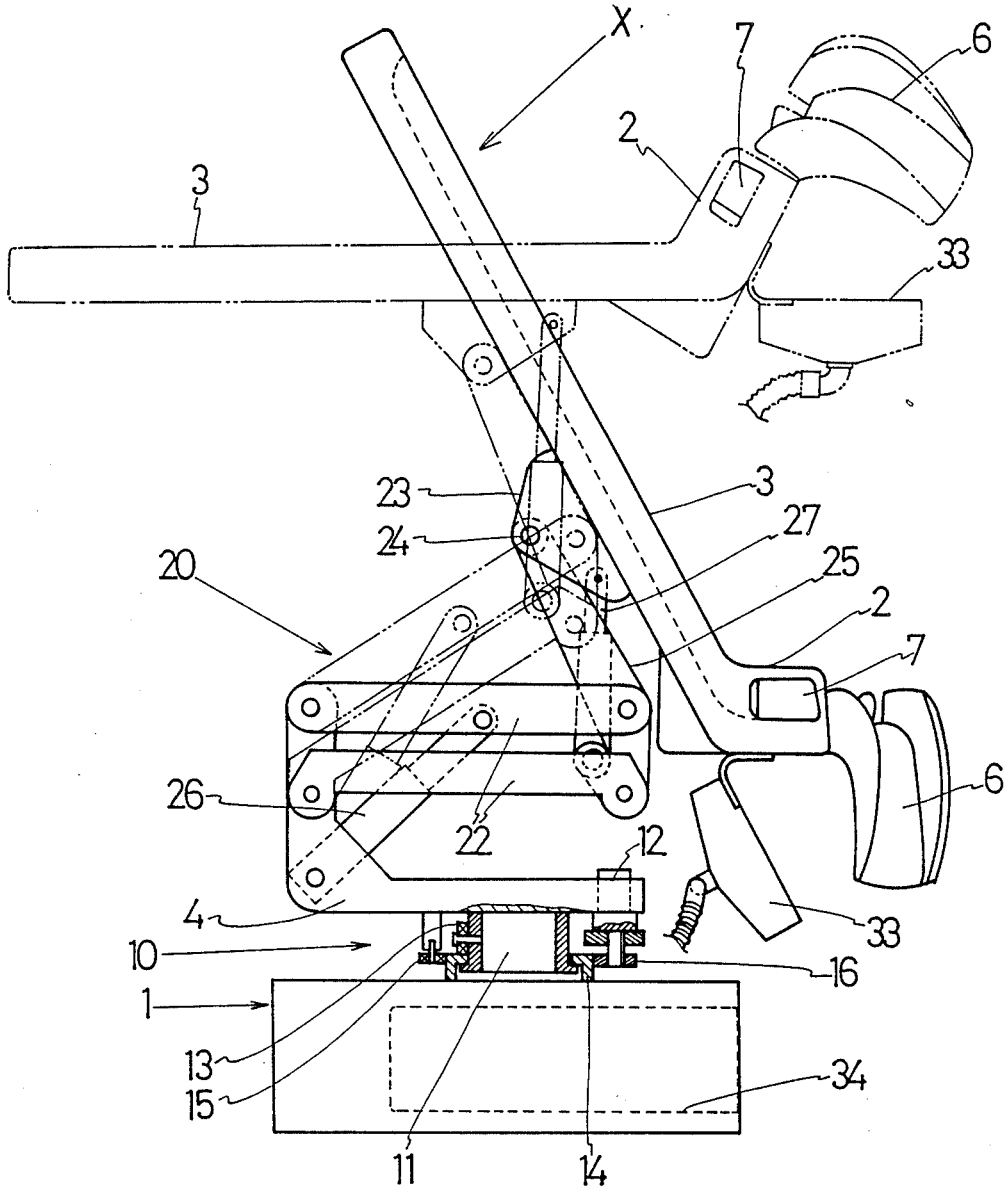
FIG. 3 is a partially broken side view showing an example of rotating and elevating devices with cover cases taken out.

The distinguishing feature of the present invention is the movement of the examining table (X). The examining table apparatus includes a mechanism which is mounted on the base (1) and functions as follows: The examining table (X) is rotated from a lower position as indicated by the solid line in FIG. 3 so that it faces the side as indicated by the single-dotted line in FIG. 2. When the examining table (X) is in this position, the patient sits on the seat board (2) from the direction shown by the arrow A in FIG. 2. Then, the examining table (X) is turned about 90 degrees, and at the same time it is raised so that the feet of the patient face the doctor and the examining table (X) is brought to a leveled position (shown by the double-dotted line in FIG. 2) so that the doctor can make the treatment easily. The examining table (X) may also be leveled by an elevating device (20) without using a rotating device (10) and this is shown by the double-dotted line in FIG. 3

Next, an example of the rotating device (10) and elevating device (20) of the examining table (X) is described. The rotating device (10) rotates the examining table (X) as well as the rotating base (4) via a driving force provided by a motor (12). More specifically, on the lower surface of the rotating base (4) a cylindrical supporting foot (11) is securely provided. The axis line of the cylindrical supporting foot (11) is perpendicular. On the outer circumferential surface of this cylindrical supporting foot (11), a plurality of rollers (13) are spacedly mounted. The rollers (13) rotate within a perpendicular surface. In particular, the rollers (13) rotate on the upper surface of a cylindrical supporting stage (14) carrying thereon the entire load applied to the base (1). The cylindrical supporting stage (14) projects from the base (1) and is coaxial in relation to the foot (11) so that it encircles the supporting foot (11).

On the lower surface and rotating circumference of the rotating base (4), a plurarity of rollers (15) are spacedly provided. In particular, the rollers (15) rotate within a horizontal surface and roll around the outer surface of the cylindrical supporting stage (14) while being kept in contact with such outer surface. Thus, the supporting foot (11) rotates coaxially to the supporting stage (14) along its inner surface. One of the plurality of rollers (15) is a driving roller (16) which is connected to a motor (12). Since the driving roller (16) rotates accompanied by friction on the outer surface of the cylindrical supporting stage (14), the examining table (X) can rotate on the base (1) together with the rotating base (4).

The elevating device (20) connects the rotating base (4) and a mounting base (23) of the examining table (X) by parallel linkages (22) and (22), a reclining supporting arm (25) and a reclining cylinder (27), and the linkages (22) and (22) and rotating base (4) are connected by an elevating hydraulic cylinder (26). When the elevating hydraulic cylinder (26) is extended or retracted, the examining table (X) is moved up or down. With the examining table (X) in a position shown by the solid line in FIG. 3, the patient can step on and off of the table (X), and with the examining table (X) in a position shown by an imaginary line, the patient is examined. Usually, the examining table (X) is rotated and elevated simultaneously so that it spirally moves up and down. Since the examining table apparatus is equipped with an air compressor, etc., the driving force used to rotate and elevate the examining table can be obtained from an air motor or air cylinders.

As an electrical control device, an electric circuit is employed in the present invention. With this circuit the rotating device 10 and the elevating device 20 of the examining table X are actuated simultaneously and the examining table X is elevated at the same time as it is rotated. Such a circuit is shown in FIGS. 4 and 5.

Figure 4:
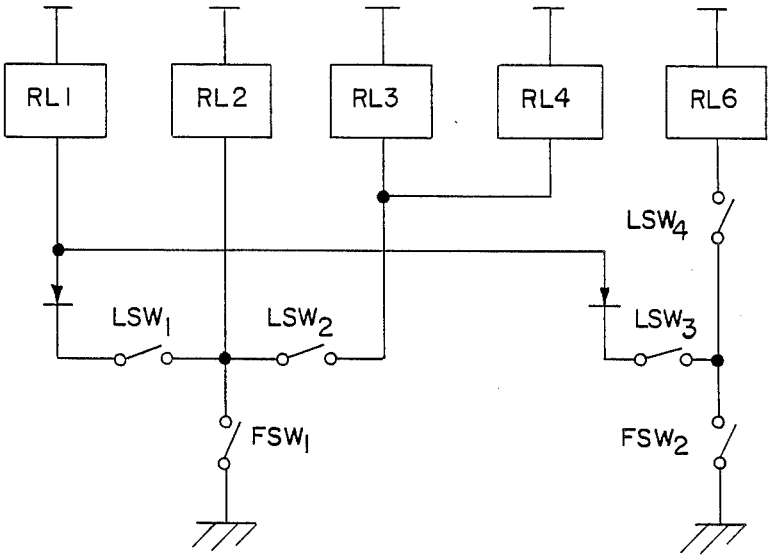
FIGS. 4 and 5 are simplified block diagrams of an electrical control device in accordance with the teachings of the present invention.
Figure 5:
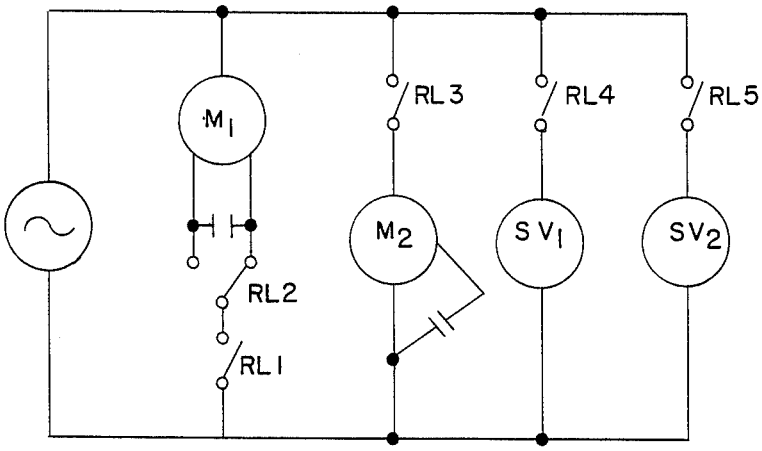

As is apparent from FIGS. 4 and 5, the electric control circuit of the present invention includes five relays RL1 through RL5, four limit switches LSW1 through LSW4 which actuate the relays RLS1 through RL5, and two foot switches FSW1 and FSW2.

The relay RL1 is for actuating the motor M1 which causes the rotation of the rotating device 10 and the relay RL2 is for changing the direction of rotation of the motor M1. The relay RL3 is for an oil pressure pump M2 which is for causing elevating movement of the elevating device 20. The relay RL4 is for an electromagnetic valve SV1 for the elevation of the examining table within an oil pressure circuit and the relay RL5 is for an electromagnetic valve for lowering SV2 the examining table X within the oil pressure circuit.

The motor M1 for the rotating device 10 is reversible. In this circuit, the motor M1 is connected so that when electricity flows in the coil of the relay RL2, the motor M1 turns in the rotating and elevating direction for the examining table X. Accordingly, when the foot switch FSW1 is pressed, the motor M1 turns in the elevating direction and simultaneously the electromagnetic valve SV1 for elevation is opened and with the oil pressure pump M2 actuated, the elevating device 20 is actuated. Thus, the examining table X is elevated while it is rotating and the person to be examined and treated can be brought to the position to be examined easily.

When the examination and treatment are over, the reset foot switch FS2 is pressed. The result is that the motor M1 turns in the reverse direction and the electromagnet valve SV2 for lowering is opened through the relay RL5, and the examining table X starts to lower by its own weight. Thus, by the reverse steps, the examining table rotates and lowers simultaneously through a spiral locus and the person examined can easily step off the table.

The examining table (X) can recline as described below.

The end of the swing side of the parallel linkage (22) is attached to the reclining supporting arm (25) which is inclined behind the back of the examining table (X), and the top end of the reclining supporting arm (25) is rotatably connected to the mounting base (23) of the examining table (X) by a swing axle (24). The base of the reclining support arm (25) and the mounting base (23) are connected by a reclining cylinder (27). When the reclining cylinder (27) is extended, the examining table (X) is leveled as shown by the double-dotted line in FIG. 3 and becomes a horizontal bed.

The rotating device (10) and elevating device (20) are respectively covered with cover cases (31) and (32) which are separated from each other on the top and bottom. The thigh crutches (6) and (6) provided on either side of the front portion of the seat board (2) position low and face downward when the patient steps onto the examining table (X). When the examination is started, they position high and face upward so that the patient can spread her legs wide enough. Thus, the present invention eliminates the problem of pregnant woman having to raise her legs high. Furthermore, according to the examining table apparatus of this invention, the patient can spread her legs by putting them on the thigh crutches (6) and (6) at a low level close to the floor by sitting down on a chair-shaped examining table (X) from the front. Thus, it is very easy for the patient to step onto the examining table and spread her legs. A foot rest (not shown) can be provided together with the thigh crutches (6) and (6).

Reference numeral (33) is a waste water receptacle, and (34) is a waste water tank. Waste water from the waste water receptacle (33) is collected in the waste water tank (34) through a flexible pipe (not shown). Inside the cover case (31) is installed a cleaning liquid tank for the waste water receptacle (33).

As described in detail above, the examining table of the present invention is structured as follows: The patient first can sit down the examining table (X) from the front of the seat board (2) in a manner similar to sitting down in a chair. Thus, the patient can step onto the examining table (X) in an easy posture and comfortable. After this, the examining table (X) is elevated while being turned about 90 degrees so that the patient can slowly be turned to face the doctor, and then the examining table (X) is inclined so that it becomes a horizontal bed. Thus, examination and treatment can be performed in an easy and comfortable posture for both the doctor and the patient. When the patient steps off of the examining table after treatment, the position of the examining table is changed in the reverse order without making the patient uneasy or in any pain.

Accordingly, accidents which can be caused by irregular postures the patient makes when stepping on and off of the examining table can be prevented, and the examining table can provide the patient with a more pleasant examination.

I claim:

1. An obstetric examining table apparatus of the type including an examining table having an open space at the center thereof and thigh crutches on right and left sides provided on a base so that said examining table can be reclined, said apparatus further comprising a means provided in said base for raising and lowering said examining table, a means provided in said base for rotating said examining table and an electric control device for controlling both said raising and lowering means and said rotating means to raise or lower said examining table and at the same time rotate said examining table through a predetermined angle to move said examining table up and down through a spiral locus.

2. An apparatus according to claim 1 wherein said angle is 90 degrees.

3. An apparatus according to claim 2 further comprising a means for leveling said examining table.

4. An apparatus to claim 3 further comprising a means for reclining said examining table.

* * * * *